US011174122B2

(12) United States Patent
Dion

(10) Patent No.: US 11,174,122 B2
(45) Date of Patent: Nov. 16, 2021

(54) REEL WITH POWER ADVANCE REPOSITIONABLE LEVEL WIND

(71) Applicant: PATCO Machine & Fab., Inc., Houston, TX (US)

(72) Inventor: Dennis Dion, Spring, TX (US)

(73) Assignee: PATCO Machine & Fab., Inc., Houston, TX (US)

( * ) Notice: Subject to any disclaimer, the term of this patent is extended or adjusted under 35 U.S.C. 154(b) by 218 days.

(21) Appl. No.: 16/391,466

(22) Filed: Apr. 23, 2019

(65) Prior Publication Data

US 2019/0322481 A1 Oct. 24, 2019

Related U.S. Application Data

(60) Provisional application No. 62/661,608, filed on Apr. 23, 2018, provisional application No. 62/663,025, filed on Apr. 26, 2018.

(51) Int. Cl.
*B65H 75/44* (2006.01)

(52) U.S. Cl.
CPC ..... *B65H 75/4407* (2013.01); *B65H 75/4402* (2013.01); *B65H 75/4489* (2013.01); *B65H 2406/41* (2013.01)

(58) Field of Classification Search
None
See application file for complete search history.

(56) References Cited

U.S. PATENT DOCUMENTS 2,548,616 A 4/1951 Priestman et al.
3,190,307 A 6/1965 de Vries
3,313,346 A 4/1967 Cross
(Continued)

FOREIGN PATENT DOCUMENTS

BE 1006560 A6 10/1994
CN 201825595 U 5/2011
(Continued)

OTHER PUBLICATIONS

Red Rooster Industrial (UK) Ltd, Hosereel/Umbilical/Transponder Winches, http://www.swlrooster.co.uk/poweredwinches_transponder.htm, last accessed Jul. 13, 2015.
(Continued)

*Primary Examiner* — William A. Rivera
(74) *Attorney, Agent, or Firm* — Beem Patent Law Firm

(57) ABSTRACT

In a reel assembly, a repositionable level wind may be selectively coupled to a drum to enable powered rotation of the level wind from a first position to a second position. In some embodiments, the assembly may include two arced guide rails, a rotating adjustment arm, a roller bracket, a winding assembly and two fork plates, which may be adjustably mounted on the drum. In operation, the fork plates may be moved to an engaged position that couples the adjustment arm and the roller bracket to the reel flanges so that rotation of the reel causes the winding assembly to be rotated along the guide rails. Once a desired position is reached, the adjustment arm and roller bracket may be bolted to the guide rails and the fork plates may be moved to a disengaged position to allow the reel to rotate independently of the winding assembly.

20 Claims, 16 Drawing Sheets

(56) References Cited

U.S. PATENT DOCUMENTS

| | | | | |
|---|---|---|---|---|
| 3,481,584 | A | 12/1969 | Robertson | |
| 3,614,019 | A | 10/1971 | Slator | |
| 3,801,071 | A | 4/1974 | Barron | |
| 3,843,096 | A | 10/1974 | Wilson | |
| 3,901,478 | A | 8/1975 | Peterson | |
| 3,934,655 | A | 1/1976 | Whistle | |
| 3,982,160 | A | 9/1976 | Goldschmidt | |
| 4,105,934 | A | 8/1978 | Jenkins | |
| 4,241,884 | A | 12/1980 | Lynch | |
| 4,261,451 | A | 4/1981 | Strong | |
| 4,410,297 | A * | 10/1983 | Lynch | E02F 5/104 242/397.3 |
| 4,475,163 | A | 10/1984 | Chandler | |
| 4,491,186 | A | 1/1985 | Alder | |
| 4,508,281 | A | 4/1985 | Plater | |
| 4,624,450 | A | 11/1986 | Christison | |
| 4,669,145 | A | 6/1987 | Kehr | |
| 4,767,073 | A * | 8/1988 | Malzacher | B65H 54/2812 242/397.3 |
| 4,871,131 | A | 10/1989 | Bernier | |
| 5,176,364 | A | 1/1993 | Bell | |
| 5,373,925 | A | 12/1994 | Handford | |
| 5,398,911 | A | 3/1995 | Holster | |
| 5,458,048 | A | 10/1995 | Hohner | |
| 5,887,815 | A * | 3/1999 | Pierce | B65H 75/4486 242/386 |
| 5,950,953 | A * | 9/1999 | Baugh | B65H 75/4407 242/397.3 |
| 6,012,684 | A | 1/2000 | Umney | |
| 6,029,951 | A | 2/2000 | Guggari | |
| 6,171,066 | B1 | 1/2001 | Irokawa | |
| 6,216,789 | B1 | 4/2001 | Lorsignol | |
| 6,328,502 | B1 | 12/2001 | Hickey | |
| 6,775,204 | B2 | 8/2004 | Scott | |
| 6,932,325 | B1 | 8/2005 | Selcer et al. | |
| 7,150,425 | B2 | 12/2006 | Banaszkiewicz | |
| 7,210,647 | B2 * | 5/2007 | Dion | B65H 75/4407 242/397.3 |
| 7,225,878 | B2 | 6/2007 | Holcomb | |
| 7,363,968 | B1 * | 4/2008 | Baugh | E21B 19/22 166/355 |
| 7,594,640 | B1 | 9/2009 | Mann | |
| 7,669,795 | B2 | 3/2010 | Brown | |
| 7,967,234 | B2 | 6/2011 | Baugh | |
| 8,061,644 | B1 * | 11/2011 | Dion | B65H 75/4402 242/397.3 |
| 8,352,210 | B2 | 1/2013 | Kranz | |
| 8,763,709 | B2 | 7/2014 | Shampine | |
| 8,820,399 | B2 | 9/2014 | Witte et al. | |
| 9,026,658 | B2 | 12/2015 | Dion | |
| 9,206,658 | B1 * | 12/2015 | Dion | E21B 19/22 |
| 9,714,154 | B2 * | 7/2017 | Haldorsen | B65H 67/06 |
| 9,810,032 | B2 | 11/2017 | Dion | |
| 9,815,528 | B2 * | 11/2017 | Baugh | B63B 27/08 |
| 10,093,522 | B1 | 10/2018 | Baugh | |
| 10,287,147 | B1 | 5/2019 | Baugh | |
| 10,494,880 | B2 | 12/2019 | Blair et al. | |
| 10,865,068 | B2 * | 12/2020 | Dion | B65H 75/4484 |
| 2003/0089400 | A1 * | 5/2003 | Cain | B65H 75/4478 137/355.26 |
| 2004/0162658 | A1 | 8/2004 | Newman | |
| 2005/0114001 | A1 | 5/2005 | Newman | |
| 2006/0000936 | A1 | 1/2006 | Caamano et al. | |
| 2006/0011765 | A1 * | 1/2006 | Dion | B65H 75/4407 242/397.3 |
| 2006/0240933 | A1 | 10/2006 | Shan | |
| 2006/0247085 | A1 | 11/2006 | Shan | |
| 2006/0249719 | A1 | 11/2006 | Lesko | |
| 2006/0273213 | A1 | 12/2006 | Turk et al. | |
| 2007/0152093 | A1 | 7/2007 | Hartzheim | |
| 2007/0246261 | A1 | 10/2007 | Lowe | |
| 2008/0116432 | A1 | 5/2008 | Folk | |
| 2008/0302289 | A1 | 12/2008 | Mann | |
| 2011/0006149 | A1 | 1/2011 | Baugh | |
| 2011/0006150 | A1 | 1/2011 | Baugh | |
| 2011/0057067 | A1 | 3/2011 | Aaland et al. | |
| 2011/0198431 | A1 | 8/2011 | Baugh | |
| 2012/0267466 | A1 | 10/2012 | Tracey et al. | |
| 2013/0161441 | A1 | 6/2013 | Bjornenak et al. | |
| 2014/0014317 | A1 | 1/2014 | Aarsland | |
| 2014/0174716 | A1 | 6/2014 | Talgo | |
| 2014/0174727 | A1 | 6/2014 | Huizer | |
| 2014/0216735 | A1 | 8/2014 | Bell et al. | |
| 2014/0271075 | A1 | 9/2014 | Pusheck | |
| 2015/0083843 | A1 | 3/2015 | Rekieta et al. | |
| 2015/0094866 | A1 | 4/2015 | Pereira et al. | |
| 2015/0371741 | A1 | 12/2015 | Leggett | |
| 2016/0114861 | A1 | 4/2016 | Janik | |
| 2016/0362945 | A1 | 12/2016 | Baugh | |
| 2016/0362946 | A1 | 12/2016 | Baugh | |
| 2016/0362947 | A1 | 12/2016 | Baugh | |
| 2016/0362948 | A1 | 12/2016 | Baugh | |
| 2017/0096864 | A1 | 4/2017 | Blair | |
| 2017/0254160 | A1 * | 9/2017 | Baugh | E21B 17/01 |
| 2018/0023354 | A1 * | 1/2018 | Dion | E21B 19/22 166/363 |
| 2019/0345013 | A1 | 11/2019 | Baugh | |
| 2019/0368299 | A1 | 12/2019 | Jorud | |
| 2020/0095089 | A1 * | 3/2020 | Zahnd | B65H 75/4484 |

FOREIGN PATENT DOCUMENTS

| | | | |
|---|---|---|---|
| CN | 201934087 | U | 8/2011 |
| CN | 201961909 | U | 9/2011 |
| CN | 102756952 | A | 10/2012 |
| GB | 816845 | A | 7/1959 |
| KR | 2012-0138357 | | 12/2012 |
| KR | 20120138357 | A | 12/2012 |
| WO | 2009032601 | A1 | 3/2009 |
| WO | 2012034460 | A1 | 3/2012 |
| WO | 2016027070 | A1 | 2/2016 |
| WO | 2016200437 | | 12/2016 |
| WO | 2016200437 | A1 | 12/2016 |
| WO | 2018226439 | A1 | 12/2018 |

OTHER PUBLICATIONS

Red Rooster Industrial (UK) Ltd, Offshore Air Winches 0AW/0MR Series, http://www.swlrooster.co.uk/poweredwinches_offshoreair.htm, last accessed Jul. 13, 2015.

Ingersol Rand, Winches and High Capacity Hoists, http://www.ingersollrandproducts.com/lifting/AirWinch%20Catalog.pdf, last accessed Jul. 13, 2015.

PATCO Machine & Fab., Inc., Equipment, http://www.patcomachandfab.com/equipment.html, last accessed Jul. 17, 2015.

PATCO Machine & Fab., Inc., Products, http://www.patcomachandfab.com/product.html, last accessed Jul. 17, 2015.

Notification of Transmittal of the International Search Report and Written Opinion dated Sep. 22, 2016, issued in International Application No. PCT/US2016/036323 (10 pages).

Dion, Dennis, "42054-R0_Sht_1_Control_Panel_Assembly", dated Apr. 18, 2006.

Dion, Dennis, "42051-R4_Pneumatic_Schematic", dated Oct. 20, 2005, with various subsequent revisions.

Dion, Dennis, "42050-R7_General_Assembly", dated Sep. 14, 2005, with various subsequent revisions.

CAD Control Systems Oil & Gas Brochure, http://cadoil.com/main/products, last accessed Mar. 6, 2019.

Six Photographs, PATCO Atlantis IWOCS Reel.

Dynacon, Inc. Winch Handling System, Offshore Source Newsletter, Jul. 2005, p. 23, vol. 7, issue 7, Technology Systems Corporation, Palm City, FL, US.

Two Photographs, Deepsea-Tech Reel.

One Photograph, Dynacon Reel.

International Search Report dated Oct. 4, 2019, issued in International Application No. PCT/US2019/028728 (3 pages).

* cited by examiner

REEL WITH POWER ADVANCE REPOSITIONABLE LEVEL WIND

RELATED APPLICATIONS

The present application is related to and claims the benefit of priority from U.S. Provisional Application No. 62/661,608 filed Apr. 23, 2018, and U.S. Provisional Application No. 62/663,025 filed Apr. 26, 2018, both of which are incorporated by reference in their entirety. This application also is related to U.S. patent application Ser. No. 16/391,785 (now U.S. Pat. No. 10,865,068), entitled "Electronically Controlled Reel Systems Including Electric Motors," filed on the same date as the present application, U.S. patent application Ser. No. 16/285,939 filed Feb. 26, 2019, which is a continuation of U.S. patent application Ser. No. 15/723,638 filed Oct. 3, 2017 (now U.S. Pat. No. 10,233,705), which is a continuation-in-part of U.S. patent application Ser. No. 14/945,195 filed Nov. 18, 2015 (now U.S. Pat. No. 9,810,032), which is a continuation of U.S. patent application Ser. No. 14/802,814 filed Jul. 17, 2015 (now U.S. Pat. No. 9,206,658), all of which are incorporated by reference in their entirety.

BACKGROUND OF THE INVENTION

1. Technical Field

The present application relates to reel systems for the receiving, storage, and deploying of cables (such as one or more electrical lines), hoses, umbilical connections (such as bundles of hydraulic lines, electrical lines, cables, hoses, and/or combinations thereof) and the like that can store operator inputs and collected, real time data.

2. Related Art

Subsea blowout prevention (BOP) equipment uses large, specialized valves or similar mechanical devices, usually installed redundantly in stacks, to seal, control and monitor oil and gas wells. Redundant sub-sea control pods are used to control the valves of the BOP stack, some of which are referred to in the industry as blue and yellow pods. The pods of the BOP stack are controlled by cables, hoses, umbilical connections and the like with various capacity outside diameters. The reel systems used for winding the cable, hoses, umbilical connections and the like onto spools, particularly on off-shore drill rigs, employ spools which are mechanically driven. Off-shore drill rigs often use multiplex cable reels, hot line hose reels, riser fill valve hose reels and the like in control systems for BOP equipment. Each of these components may provide various functionalities. In a typical rig, four spools may provide control cables for a BOP stack. These components may function as follows: multiplex cable reel assemblies may be used to pay out and retrieve multiplex cables that may be used to transmit electric signals to allow for the control of sub-sea hydraulic functions on the sub-sea blue and yellow pods; a hot line hose reel assembly may be used to pay out and retrieve a hose that provides hydraulic fluid from the drilling rig deck to the sub-sea pods to allow for the control of sub-sea hydraulic functions on the sub-sea blue and yellow pods; and a riser fill valve hose reel assembly may pay out and retrieve a hose that, in response to a sudden pressure differential between the inside and outside of a riser, opens to allow the riser to fill with seawater and thus equalizing the pressure differential and preventing collapse of the riser.

In operation, the spools are typically located on the drillship near a moon pool area (i.e. the opening in the floor or base of the platform to provide access to the water below) and may be on different levels depending on the rig design. The cable or hose often is deployed from the spool to an overhead roller type turn down sheave, or multiple sheaves, to direct the cable or hose to the blue and yellow pods on the BOP stack assembly in the drill ship's moon pool.

Typical systems employ manual, pneumatically-controlled, mechanical control systems for each of the individual reel assemblies, to position the sub-sea end of the cable or hose to the pod. Once the cables and hoses are connected to the pods, the operation of deploying the BOP stack begins. Drill pipe and flotation risers having typical lengths of 60 to 90 feet or more (nominally, about 18 to 28 meters) are attached to the stack. The cables and hoses are attached to clamps located on the riser as the 60 or 90 foot (nominally, about 18 to 28 meters) sections are made up. The reels are not rotating while the drill pipe and riser sections are made up. Once made up, the reels begin rotating to deploy the cables and hoses until the next section is ready to be attached. This operation continues until the BOP stack is anchored to the sea bed floor. A control stand may be located away from the spools, in the moon pool area, with a clear vision of the deployment. The operator at the remote control stand may be able to operate one or more of the reel assemblies and may make adjustments as may be necessary during the operation.

In a typical reel assembly, as the cable is wound onto or off of the spool, it is guided by a cable guide or "level wind" assembly mounted for traversing a reversible diamond groove shaft parallel to the axis of the spool. The cable guide assembly is coupled to tracking guide bars. Thus, the cable guide assembly traverses the diamond groove shaft and guide bars from one side to the other, evenly distributing the cable on the hub of the spool. When the cable gets to one end of the diamond groove shaft, it automatically reverses and continues to traverse in the other direction, continuously feeding the cable onto the spool. Many reels have been manufactured with this familiar diamond pattern lead screw mechanism to cause the line being wound onto the drum of the reel to be wrapped in an orderly and compact fashion. Probably the most common of these is the fishing reel.

Currently level wind assemblies suffer from various shortcomings. For example, level wind assemblies may need to be positioned at various angles depending on the particular configuration of the reel assembly in the moon pool. However, these assemblies are difficult to reposition due to their weight and the forces exerted upon them by gravity and/or the cables that may be laced through them. Typically, additional equipment such as cranes are required to raise or lower the level wind assembly into the desired position. This process is time-consuming, expensive and difficult to perform on a rig that may be constantly in motion with the water below.

Accordingly, a need has long existed for improved systems and methods for repositioning level wind assemblies on cable spooling systems.

SUMMARY

In a reel assembly, a repositionable level wind may be selectively coupled to a drum to enable powered rotation of the level wind from a first position to a second position. In some embodiments, the assembly may include two arced guide rails, a rotating adjustment arm, a roller bracket, a winding assembly and two fork plates, which may be adjustably mounted on the drum. In operation, the fork plates may be moved to an engaged position that couples the adjustment arm and the roller bracket to the reel flanges so that rotation of the reel causes the winding assembly to be rotated along the guide rails. Once a desired position is reached, the adjustment arm and roller bracket may be bolted to the guide rails and the fork plates may be moved to a disengaged position to allow the reel to rotate independently of the winding assembly. A reposition mode may be provided by a control system for the reel that provides lower output rotational speed than the normal operating mode to allow for precise control during repositioning.

Other systems, methods, features and technical advantages of the invention will be, or will become apparent to one with skill in the art, upon examination of the figures and detailed description. It is intended that all such additional systems, methods, features and technical advantages be included within this summary and be protected by the claims.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION OF THE PREFERRED EMBODIMENTS

The elements illustrated in the figures interoperate as explained in more detail below. Before setting forth the detailed explanation, however, it is noted that all of the discussion below, regardless of the particular implementation being described, is exemplary in nature, rather than limiting.

1.0 System Overview

Referring to FIGS. 1*a-b* and 2*a-b*, an exemplary reel assembly 10 having a repositionable level wind 100 are shown. Although the terms "cable," "hose," "umbilical," and "cable/hose" are used to describe various aspects of the embodiments described herein, it should be understood by one of ordinary skill in the art that the embodiments may be used in combination with cables, hoses, umbilical connections and the like and that use of the terms is exemplary in nature and not limiting. In FIGS. 1*a-b*, 2*a-b*, and 6*a-b*, an exemplary embodiment is shown in its entirety. In FIGS. 3-5, 9*a-d*, 10*a-b* and 11*a-c*, various components of the embodiments have been removed to better show and highlight certain aspects. The specific components that have been removed in each Figure are noted below when those figures are described in more detail.

Figure 3:
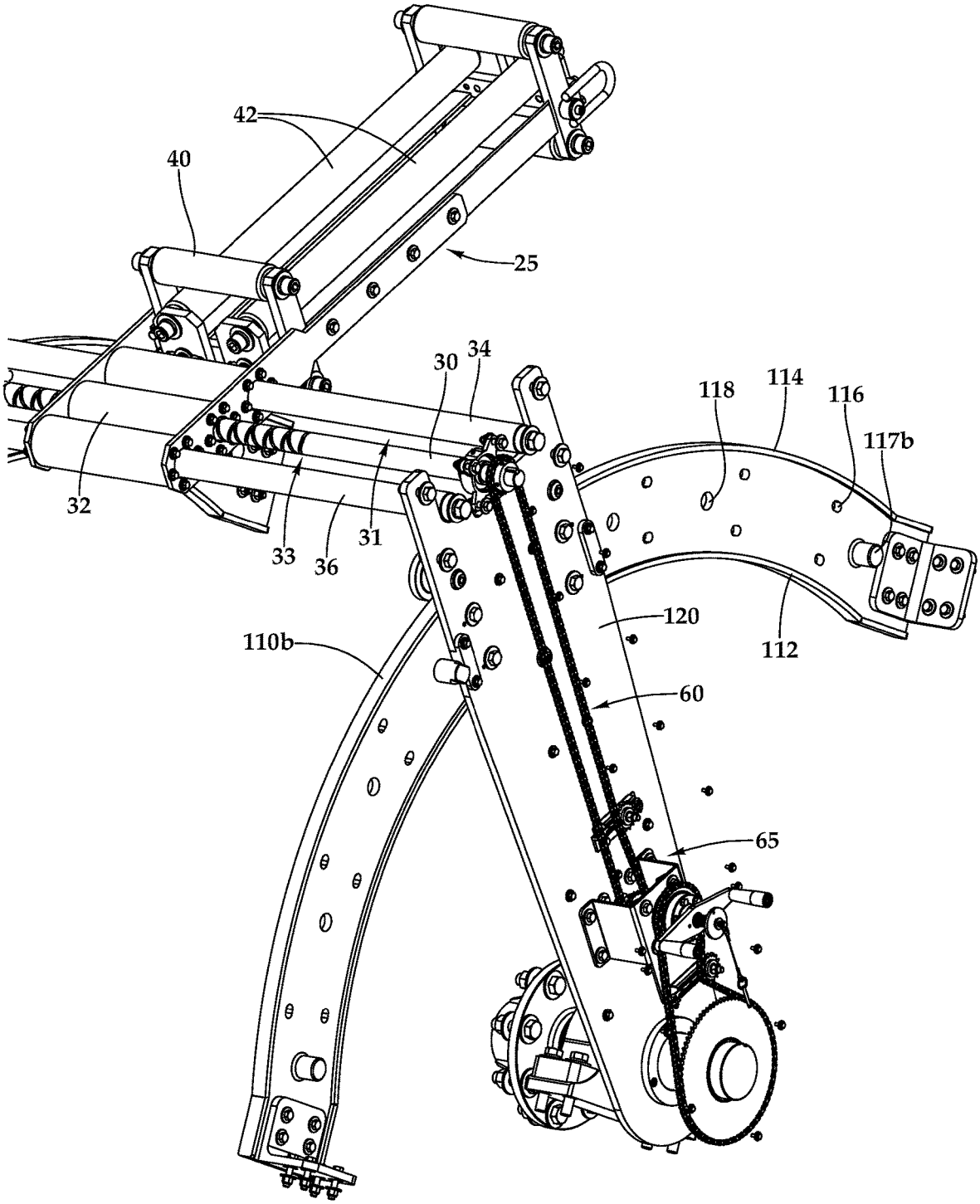
FIG. 3 shows a perspective view of portions of a guide rail and rotatable adjustment arm of an exemplary repositionable level wind.

Referring also to FIG. 3, exemplary reel assembly 10 may comprise a frame 11 which rotatably supports a cable drum 12 having a core or hub 14 and opposite end flanges 16. A cable may be guided onto and off from the spool for even wrapping by means of a cable guide or "level wind" assembly 25 having a carriage mounted for traversing a reversible diamond groove shaft 30 by means of a follower 32, as the shaft 30 is rotated.

As described in more detail below, the level wind assembly 25 may be part of a repositionable level wind assembly 100 in which the level wind 25 may be selectively coupled to the drum 12 for powered movement of the level wind 25. In other words, the level wind 25 may be coupled to the drum 12 so that movement of the drum 12 causes movement of level wind 25.

The carriage may be coupled to a pair of tracking guide bars 34, 36. The carriage also may mount a frame holding two sets of freely rotating rollers 40, 42 for contacting and guiding the cable. Upper and lower rollers 40, and right and left rollers 42, may be a relatively hard steel material or be coated with resilient materials such as rubber or plastics. Thus, the carriage may traverse the diamond groove shaft 30 from one side to the other, evenly distributing the cable on the hub 14 of the drum 12. When the carriage gets to one end of the diamond groove shaft 30, it may automatically reverse and continue to traverse in the other direction, continuously feeding the cable onto or off from the spool.

Drum 12 may have a diameter between about 30 inches (nominally, about 75 centimeters) and about 120 inches (nominally, about 30 centimeters) or more, preferably between about 48 inches (nominally, about 120 centimeters) and about 72 inches (nominally, about 185 centimeters), and may have a width between about 50 inches (nominally, about 125 centimeters) and about 150 inches, and preferably between about 72 inches and about 120 inches (nominally, about 300 centimeters). The flanges 16 may have a diameter between about 48 inches (nominally, about 120 centimeters) and about 205 inches (nominally, about 525 centimeters), preferably between about 60 (nominally, about 150 centimeters) inches and about 180 inches (nominally, about 460 centimeters).

The cable/hose may have a length between about 4,000 feet (nominally, about 1,200 meters) and about 20,000 feet (nominally, about 6,100 meters), preferably between about 7,000 feet (nominally, about 2,100 meters) and about 15,000 feet (nominally, about 4,600 meters) and even more preferably between about 11,000 feet (nominally, about 3,300 meters) and about 13,000 feet (nominally, about 4,000 meters). An exemplary cable may have a diameter between about ½ of an inch (nominally, about 1.2 centimeters) and about 2½ inches (nominally, about 6 centimeters), and typically about between about 1¼ inches (nominally, about 3.5 centimeters) and about 1¾ (nominally, about 4.5 centimeters). An exemplary hose may have a diameter between about 1½ inches (nominally, about 3.8 centimeters) and about 2½ inches (nominally, about 6 centimeters), and an exemplary umbilical connection may have a diameter between about 2 inches (nominally, about 5 centimeters) and about 8 inches (nominally, about 20 centimeters). Other sizes also may be used.

Referring also to FIG. 3, the level wind assembly 25 may be driven by a chain linkage 60 coupled to the drum 12 hub via a clutch 65, in which the outer cover of the adjustment arm 120 has been removed to show the components disposed therein. Preferably, the chain linkage 60 is configured to rotate the diamond screw shaft 30 the equivalent of one diameter of the cable for each rotation of the drum 12. For example, if the diameter of the cable is 4", the diamond screw shaft 30 should about move 4" for each rotation of the drum 12.

2.0 Exemplary Repositionable Level Wind 100

Referring to FIGS. 1*a-b*, 2*a-b* and 3, the repositionable level wind 100 may include two arced guide rails 110*a-b*, a rotating adjustment arm 120, a roller bracket 130 and a level wind assembly 25. In addition, two forks or fork plates 140*a-b* may be adjustable mounted on the drum 12, as shown in FIGS. 9*a-d*. In operation, fork plates 140*a-b* may be moved to an engaged position that couples the adjustment arm 120 and the roller bracket 130 to the reel flanges 16 so that rotation of the reel causes the winding assembly 25 to rotate along the guide rails 110*a-b*. Once the winding assembly is in a desired position, the adjustment arm 120 and roller bracket 130 may be bolted to the guide rails 110*a-b* and the fork plates may be moved to a disengaged position to allow the reel to rotate independently of the now fixed level wind assembly 25, as described in more detail below.

2.1 Exemplary Guide Rails 110*a-b*

Figure 4:
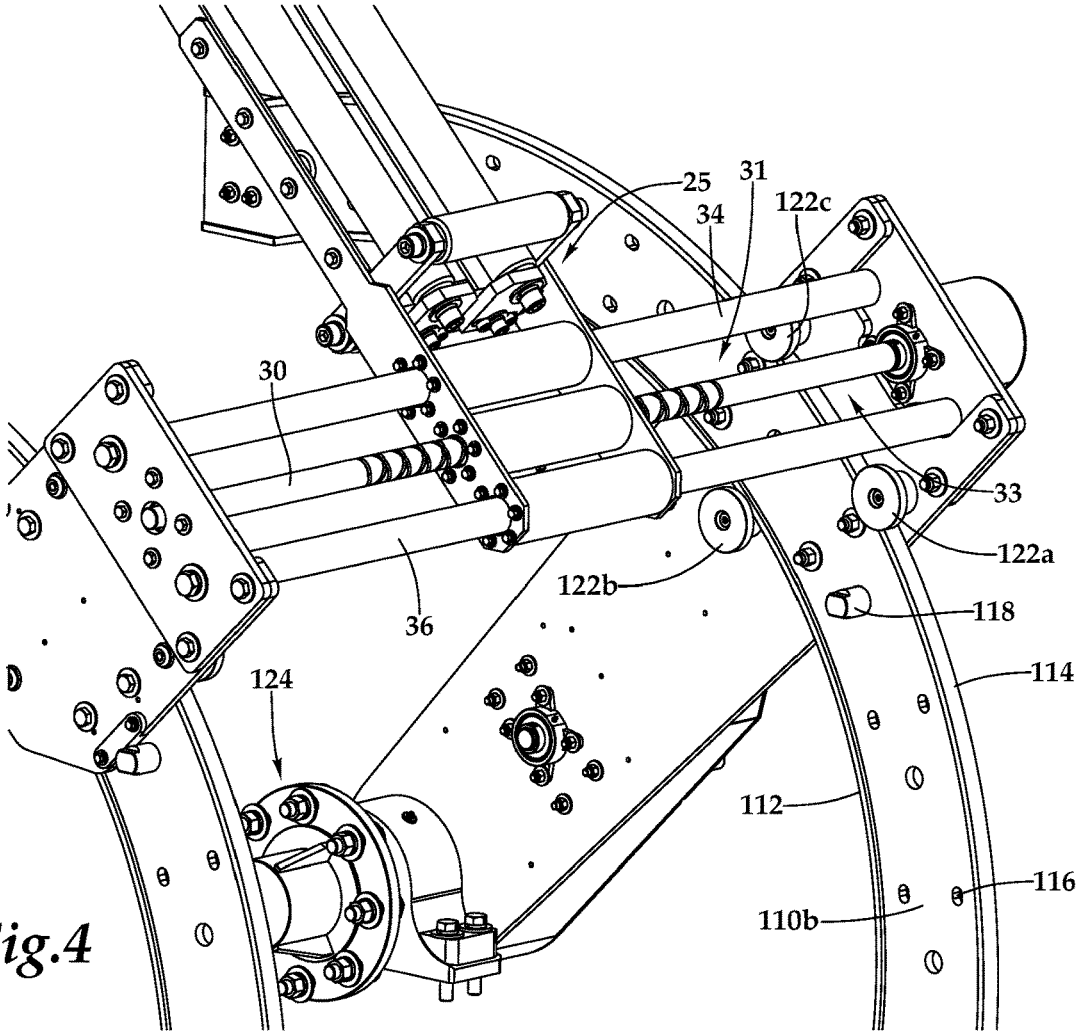
FIG. 4 shows another perspective view of portions of a guide rail and rotatable adjustment arm of an exemplary repositionable level wind.

Referring also to FIGS. 3 and 4, the arced guide rails 110*a-b* may be coupled to the frame 11 by brackets 102*a-b* and 104*a-b*. In FIGS. 3 and 4, the frame 11, drum 12, fork plate 140*b* and outer cover of the adjustment arm 120 have been removed to better illustrate the components disposed in and on the guide arm 120 and their interaction with the guide rail 110*b*. Each guide rail 110*a-b* may include a lower track 112, an upper track 114, and a plurality of apertures 116. The apertures may define fixed positions at which the rotating adjustment arm 120 may be fixed to reposition the level wind 25. Preferably, apertures 116 are positioned to allow the rotating adjustment arm 120 to be repositioned at set increments from 0 to 90 degrees, i.e. horizontal to vertical deployment. In the illustrated embodiment, the rotating adjustment arm 120 may include apertures 422*a-d* (FIG. 11*c*) to allow it to be bolted to the four apertures 116 of the guide rail 110*b* to fix the adjustment arm 120 in position, and the apertures 116 are disposed on the guide rail 110*b* so as to allow increments of rotation of about 15 degrees. Other numbers of apertures 116 and increments of rotation may be used.

Figure 1A:
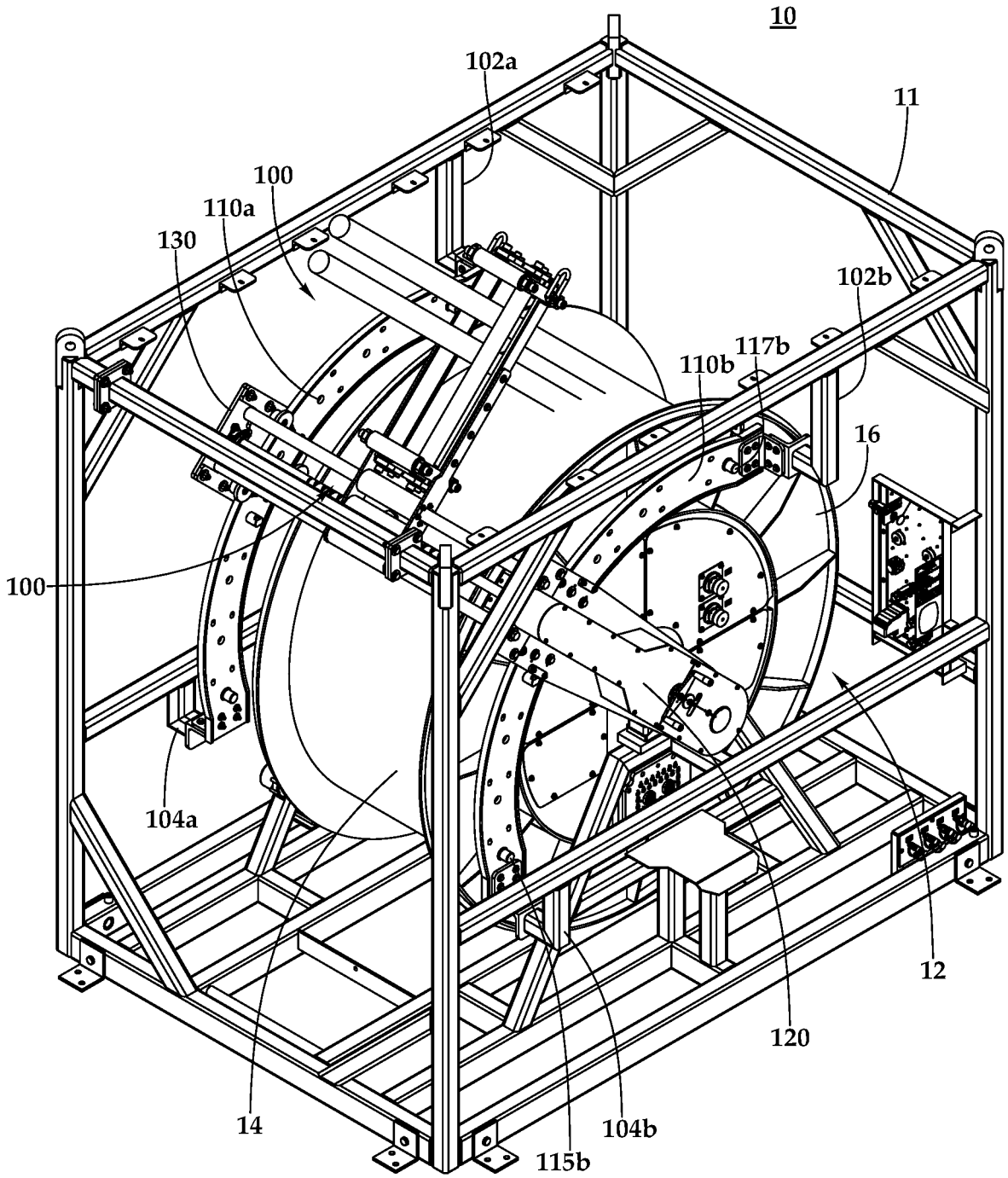
FIGS. 1*a-b* show perspective views of an exemplary reel assembly having a repositionable level wind.
Figure 1B:
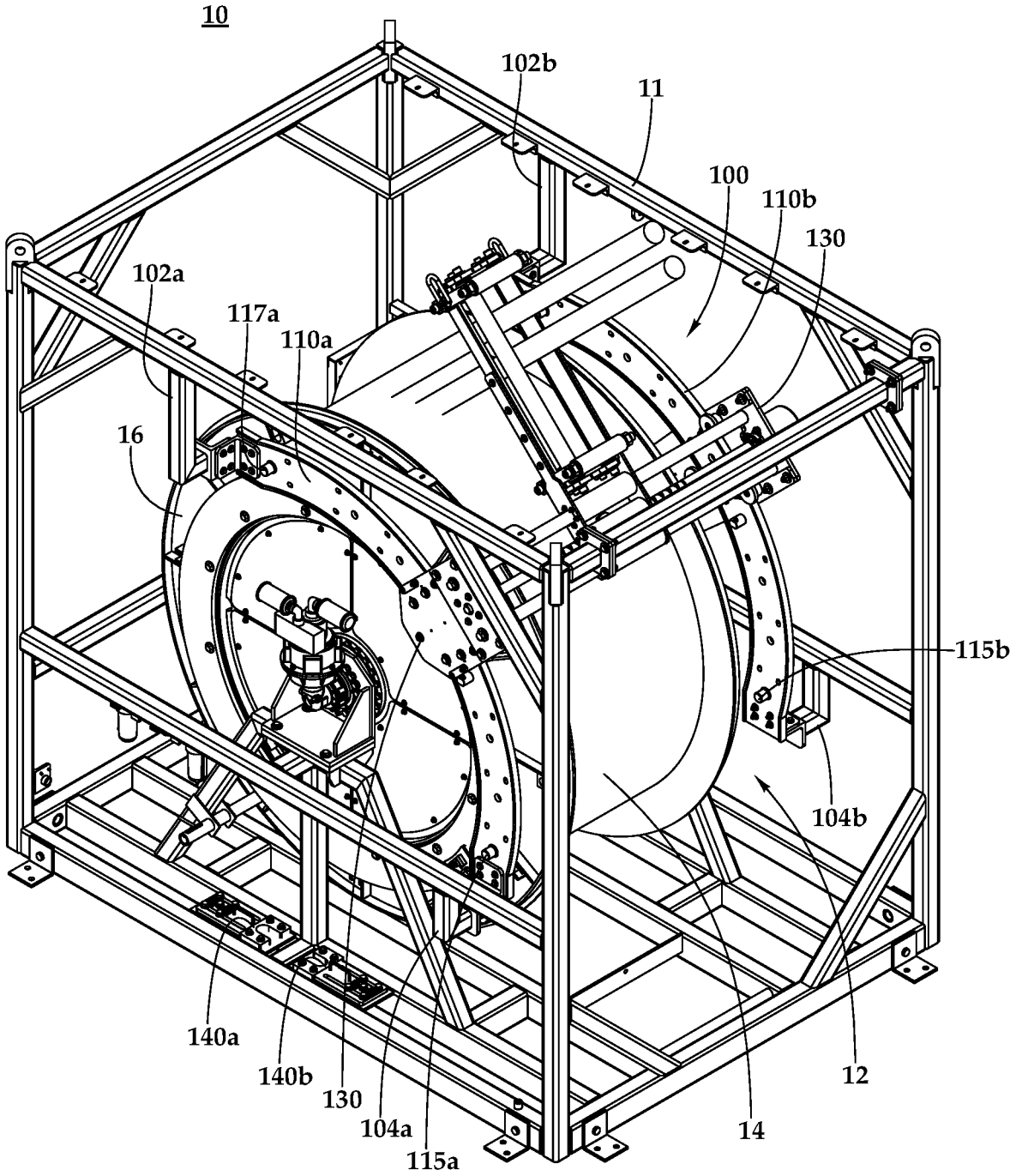
Figure 10A:
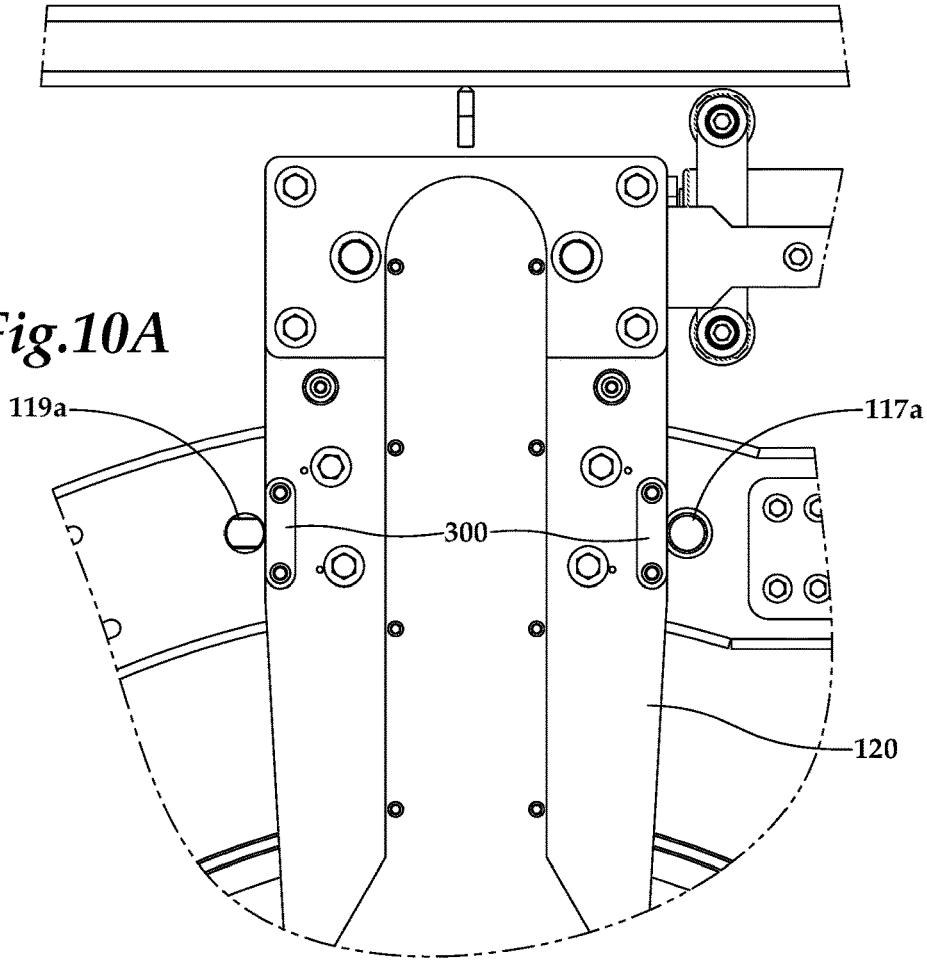
FIG. 10*a* shows a side view of an exemplary adjustment arm having bumpers for absorbing contact with stops.
Figure 10B:
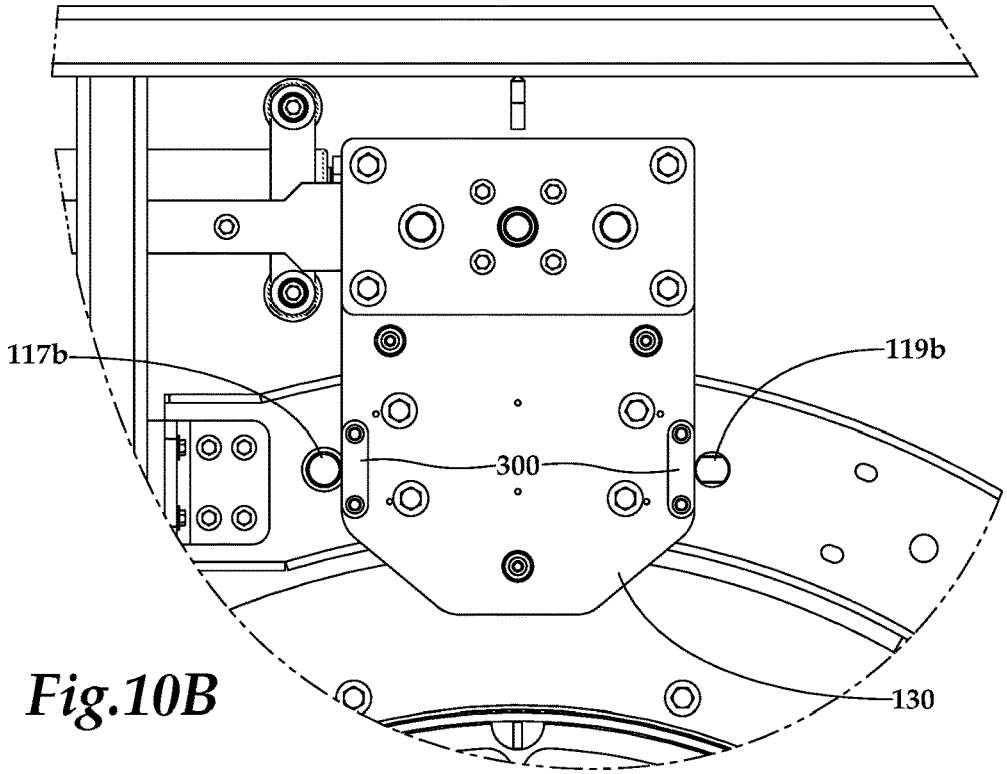
FIG. 10*b* shows a side view of an exemplary roller bracket having bumpers for absorbing contact with stops.

In some embodiments, stops 117*a-b* may be provided on the guide rails 110*a-b* to prevent the adjustment arm 120 and/or roller bracket 130 from rotating past a certain position, as shown in FIG. 1*b*. In the illustrated embodiment, stops 117*a-b* are positioned to prevent the adjustment arm 120 and/or roller bracket 130 from rotating past a substantially vertical position (e.g. about 90°), and lower stops 115*a-b* (FIGS. 1*a-b*) are positioned to prevent the adjustment arm 120 and/or roller bracket 130 from rotating past a substantially horizontal position (e.g. about 0°). Additionally, or alternatively, removable pegs 119*a-b* may be provided in apertures 118 (FIG. 3) in the guide rails 110*a-b* to provide additional support for and/or to prevent rotation of the adjustment arm 120 and/or roller bracket 130, as shown in FIGS. 10*a-b*.

2.2 Exemplary Rotatable Adjustment Arms 120 and Roller Bracket 130

As shown in FIGS. 3 and 4, the rotatable adjustment arm 120 may be coupled to the drum 12 via a bearing assembly 124 that allows it to rotate freely about the center axis of the spool. The adjustment arm 120 also may be fixedly coupled to the guide rods 34 and 36 of the level wind assembly 25 and rotatably coupled to the diamond screw shaft 30. In addition, the adjustment arm 120 may include rollers 122*a-c* that engage the upper and lower tracks 114 and 112 of the guide rail 110*b*. In the illustrated embodiments, each roller 122*a-c* is a stainless steel roller that freely rotates about a center axis and includes a 3" diameter and a 4" flange to secure the adjustment arm 120 to the guide rail 120*b*. As illustrated, rollers 122*a* and 122*c* are disposed to engage upper track 114 and roller 122*b* (FIG. 4) is disposed to engage lower track 112. Other numbers and arrangements of rollers 122*a-c* may be used.

Figure 2A:
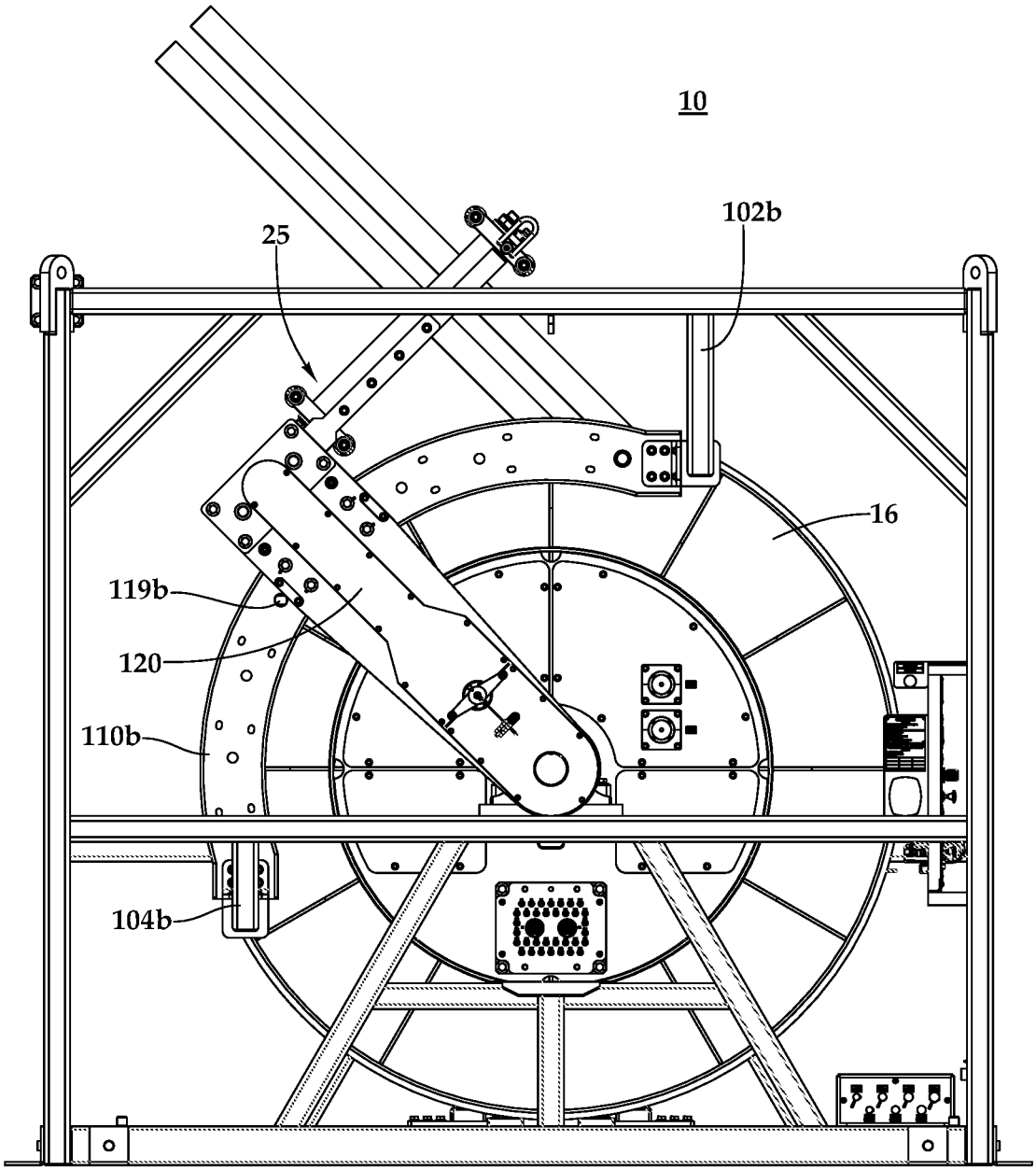
FIGS. 2*a-b* show side views of the exemplary reel assembly of FIGS. 1*a-b;*
Figure 2B:
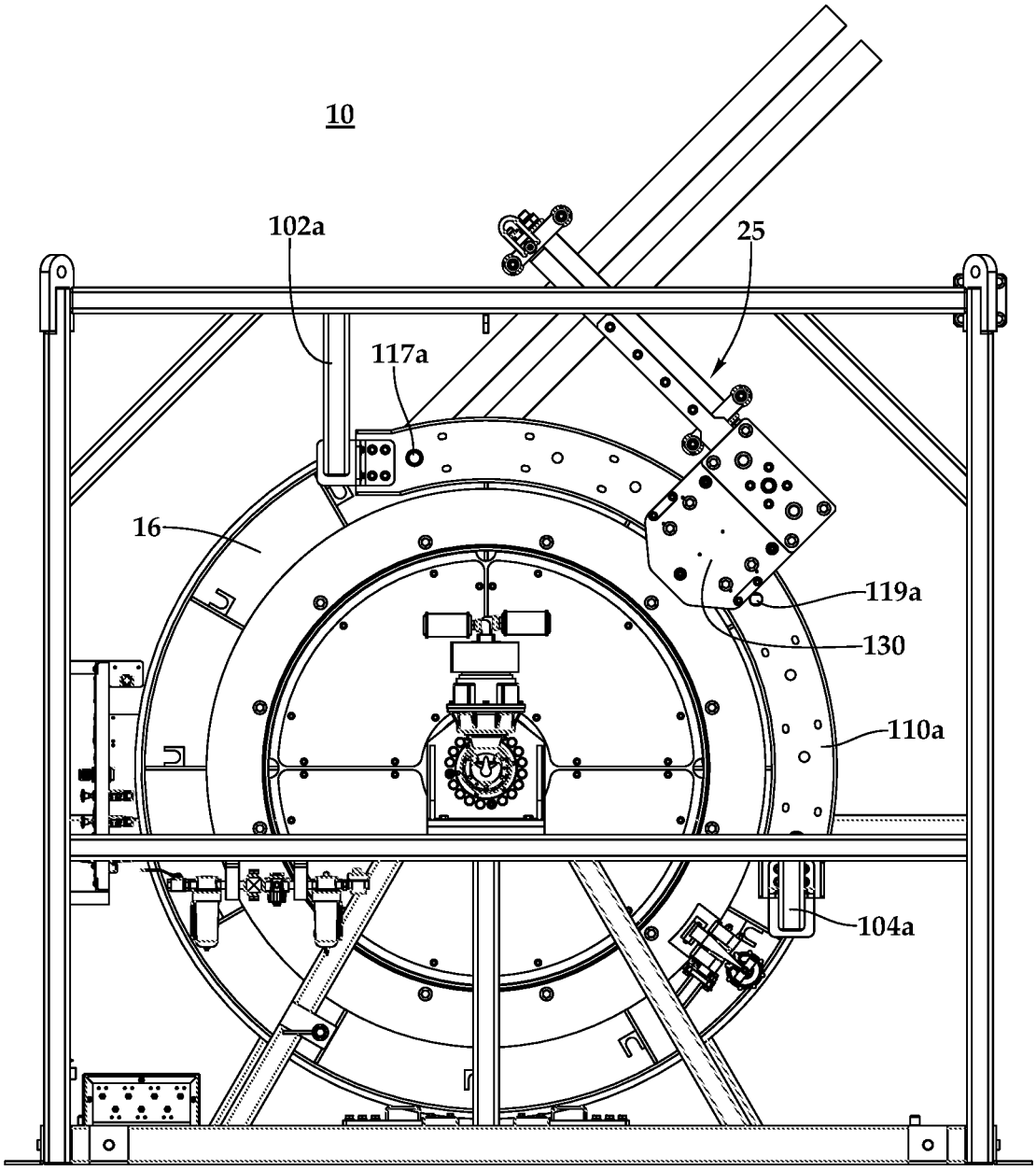

The roller bracket 130 may include a similar arrangement of rollers 122*a-c* and the like but may not be coupled directly to the center of drum 12 like the rotatable adjustment arm, as best shown in FIG. 2*b*. For example, the roller bracket 130 also may be fixedly coupled to the guide rods 34 and 36 of the level wind assembly 25 and rotatably coupled to the diamond screw shaft 30. In addition, the roller bracket 130 also may include rollers 122*a-c* that engage the upper and lower tracks 114 and 112 of the guide rail 110*a*.

Figure 11A:
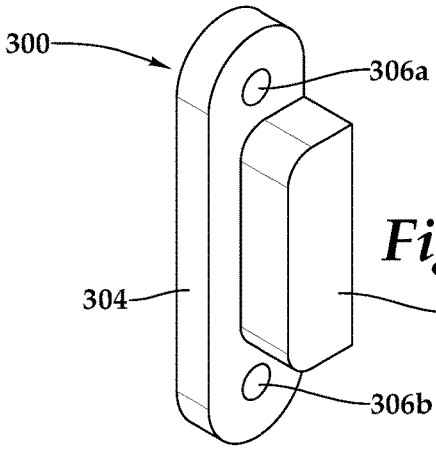
FIG. 11*a* shows a perspective view of an exemplary bumper.
Figure 11B:
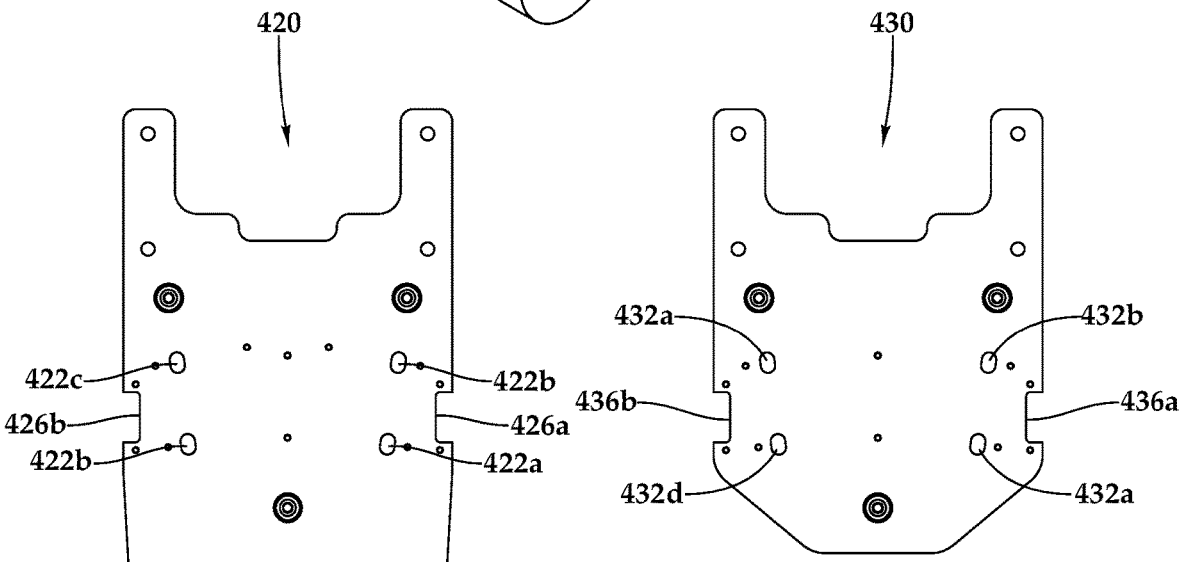
FIG. 11*b* shows a front view of an exemplary adjustment arm plate.
Figure 11C:
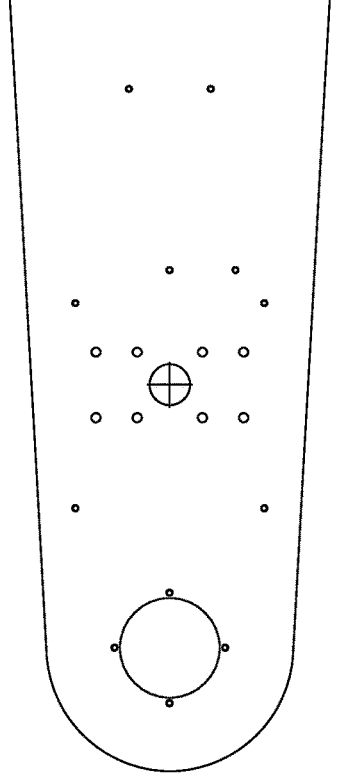
FIG. 11*c* shows a perspective view of an exemplary roller bracket plate.

In some embodiments, the adjustment arm 120 and/or roller bracket 130 may include one or more bumpers 300 for absorbing contact with upper stops 117*a-b*, lower stops 115*a-b* (FIGS. 1*a-b*), and/or pegs 119*a-b*, as shown in FIGS. 10*a* and 10*b*, respectively. As shown in FIG. 11*a*, the bumper 300 may include a contact absorption portion 302 attached to body 304 that includes apertures 306*a-b* that allow the bumper to be attached to the adjustment arm 120 or roller bracket 130. In such embodiments, the adjustment arm plate 420 and/or roller bracket plate 430 may include recessed portions 426*a-b* and 436*a-b* respectively for receiving the contact absorption portion 302 of the bumper 300, as shown in FIGS. 11*b* and 11*c*, respectively.

The bumper 100 may be made of any suitable material for absorbing contact with the stops 117*a-b* and/or pegs 119*a-b*, such as rubber or the like. In some embodiments, the bumper may be made of UHMW-UV or similar material, which may be durable and resist wear, corrosion, and UV-related damage. Other materials also may be used. In some embodiments, different portions of the bumper 300 may be made of different materials. The contact absorption portion of the bumper 302 may be between about 1 inch and about 5 inches, preferably between about 2 inches and about 4 inches, and even more preferably between about 2.5 inches and about 3.5 inches. In the illustrated embodiment, the contact absorption portion 302 is about 3 inches.

2.3 Exemplary Forks Plates 140*a* and 140*b*

Figure 5:
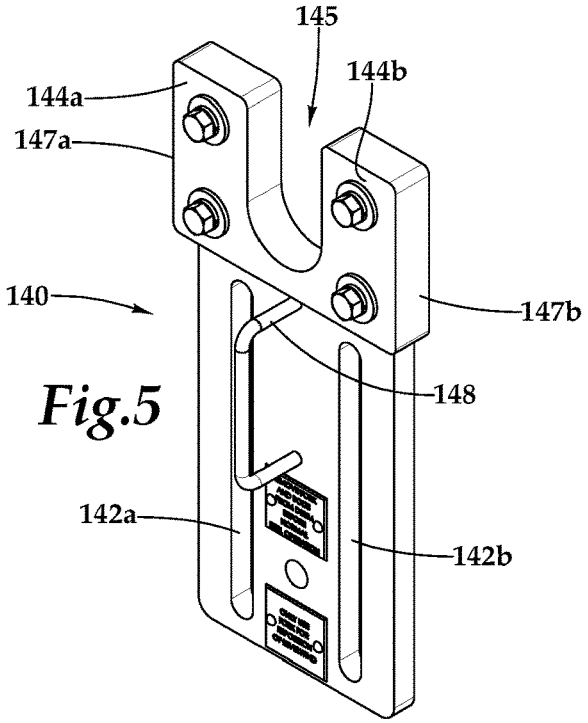
FIG. 5 shows a perspective view of an exemplary fork for selectively coupling the exemplary repositionable level wind with a spool.
Figure 6A:
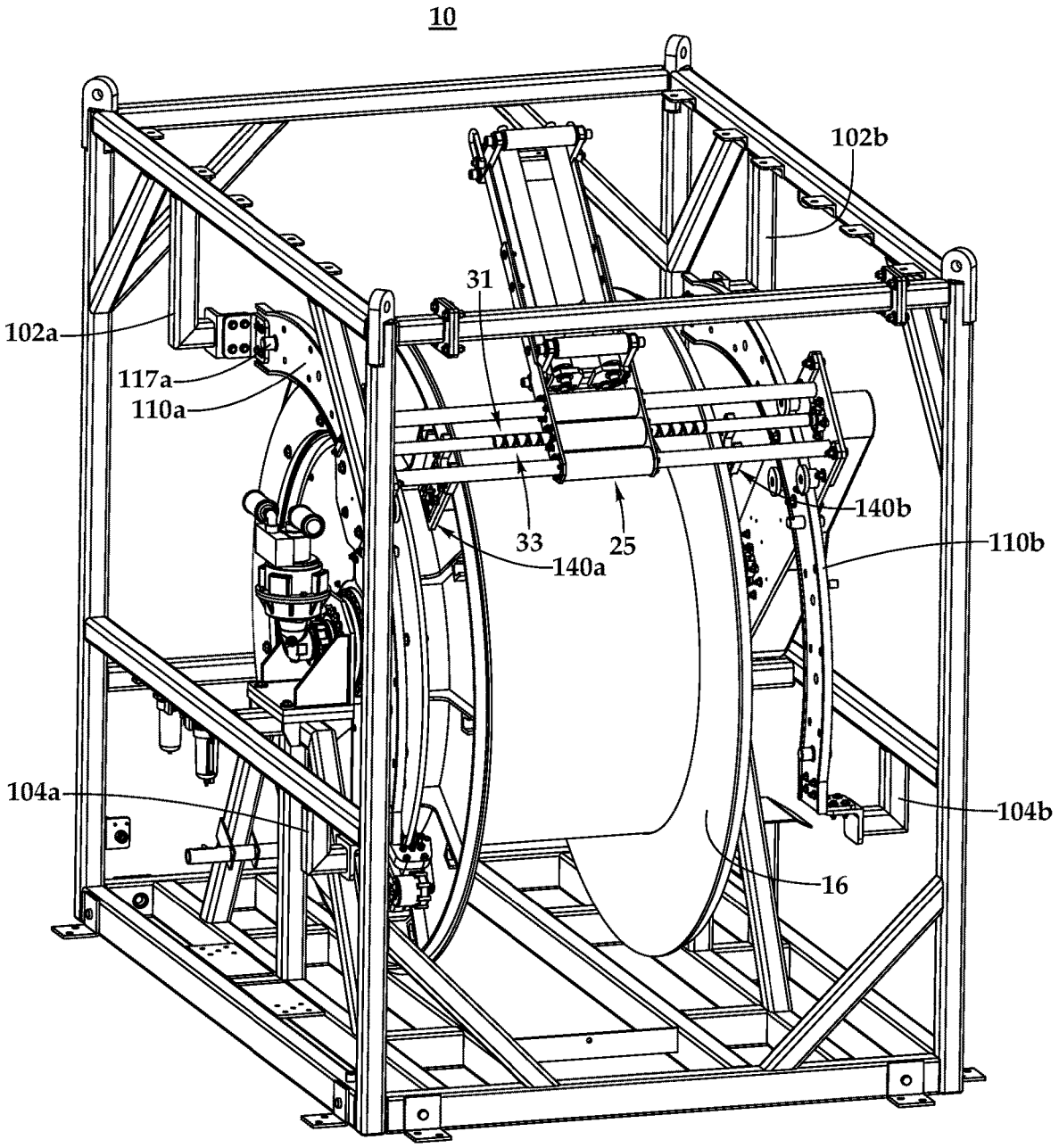
FIG. 6*a* shows a perspective view of portions of a rotatable adjustment arm of an exemplary repositionable level wind having a reel attachment plate in a disengaged position.
Figure 6B:
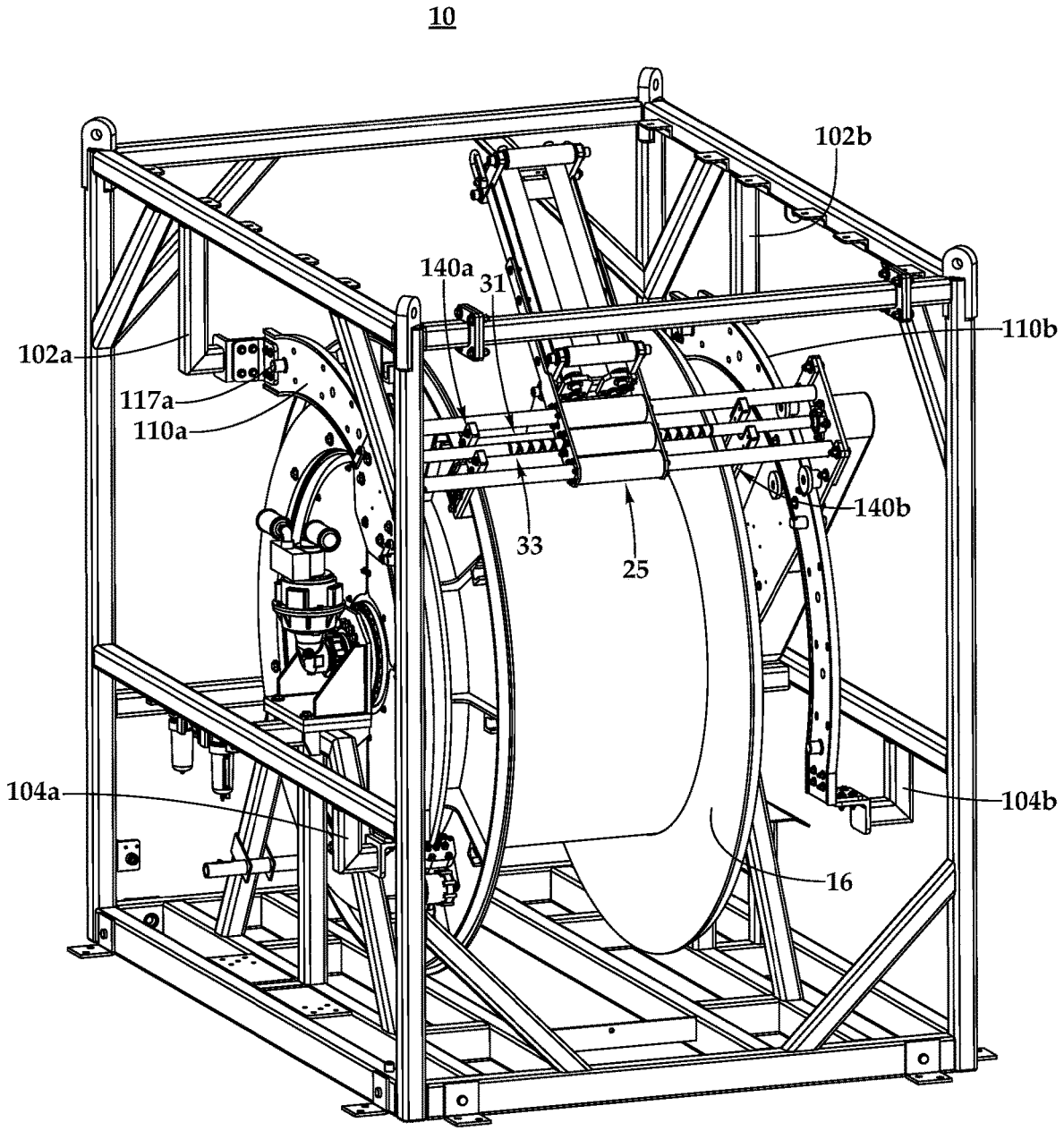
FIG. 6*b* shows a perspective view of portions of a rotatable adjustment arm of an exemplary repositionable level wind having a reel attachment plate in an engaged position.

Referring to FIG. 5 and FIGS. 6*a-b*, an exemplary fork plate 140 and perspective views of an exemplary reel assembly 10 having a repositionable level wind 100 is shown with exemplary fork plates 140*a-b* in both disengaged and engaged positions, respectively. As shown in FIG. 5, each fork plate 140 may include slots 142*a-b* that may receive bolts for attaching the fork plate 140 to the reel flange 16 at various positions. Each fork plate 140 also may include two tines 144*a* and 144*b* that define a channel 145 for receiving the diamond screw shaft 30. In the illustrated embodiment, the channel may be a slot having a circular end 145 for receiving the diamond screw shaft having a 1.5" radius that is centered about 3" from the top of the tines 144*a-b*. In addition, pads 147*a* and 147*b* may be attached to the tines 144*a-b* to allow the fork plate to push against guide rods 34 and 36 during repositioning of the winding assembly 25, as described in more detail below. The pads 147*a-b* may be Nylatron or another suitable material.

For example, the fork plates 140*a-b* may be moved to a disengaged position to allow the reel to rotate independently of the winding assembly 25, as shown in FIG. 6*a*. In the disengaged (or first) position, the fork plates 140*a-b* may be attached to the reel 12 and may not contact the level wind 25. Because the level wind 25 is not coupled to the drum 12 when the fork plates 140*a-b* are in the disengaged position, the drum 12 is free to rotate 360° or more as necessary to deploy or wind the cable. The fork plates 140*a-b* also may be stored on the base of the skid frame as illustrated in FIG. 1B during normal operation of the reel.

Alternatively, fork plates 140*a-b* may be moved to an engaged (or second) position that couples the adjustment arm 120 and the roller bracket 130 to the reel flanges 16 so that rotation of the reel causes the winding assembly 25 to rotated along the guide rails 110*a-b*, as shown in FIG. 6*b* for guide rail 110*a*. In the engaged (or second) position, the tines 144*a-b* of the fork plates 140*a-b* may engage gaps 31 and 33 between the diamond screw shaft 30 and the tracking guide bars 34 and 36 of the level wind 25. As a result of this coupling, movement of the drum 12 will cause movement of the level wind 25.

Figure 7:
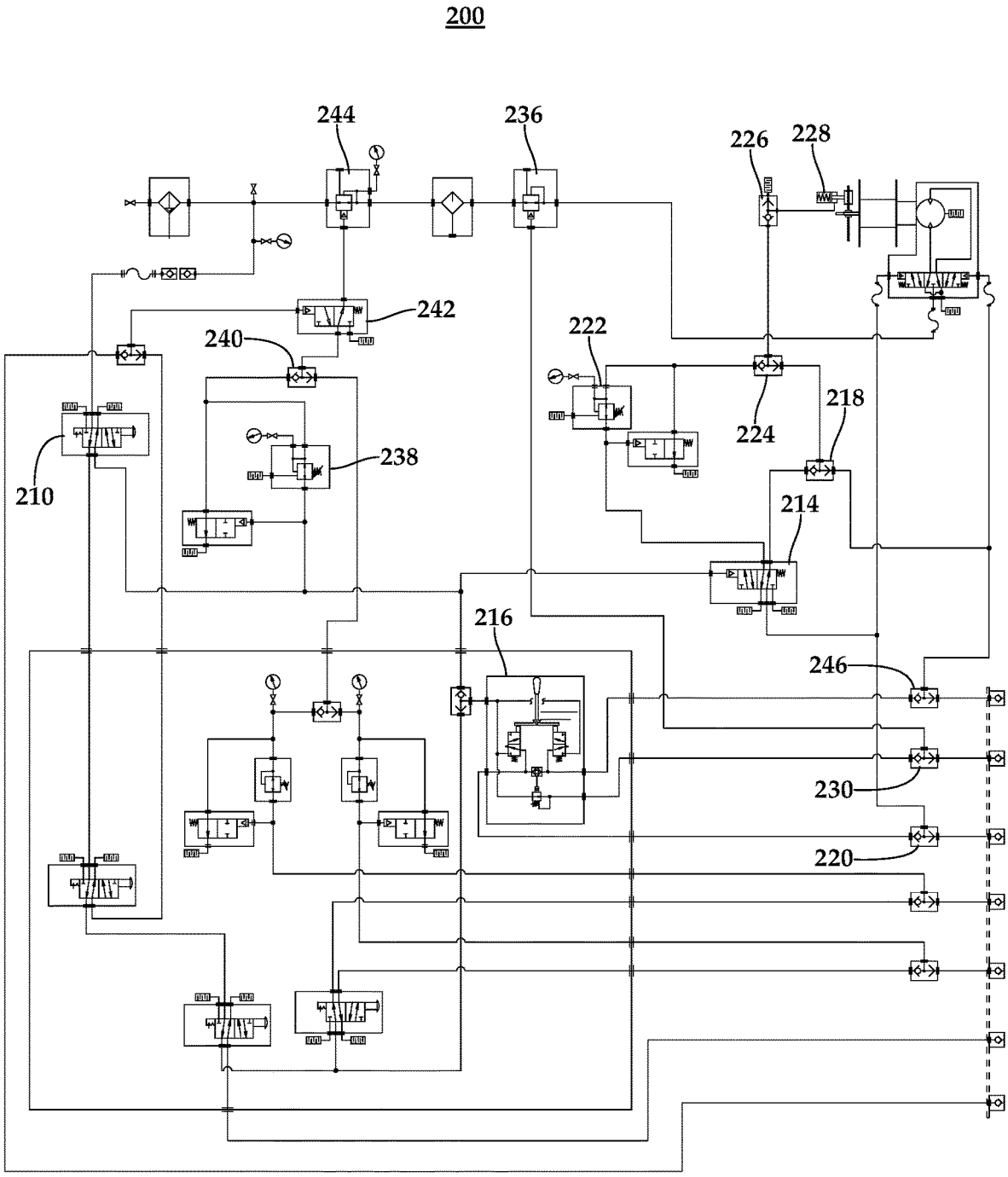
FIG. 7 shows a schematic diagram illustrating the operation of an exemplary pneumatic drive system for use in an exemplary reel assembly having a repositionable level wind.
Figure 8:
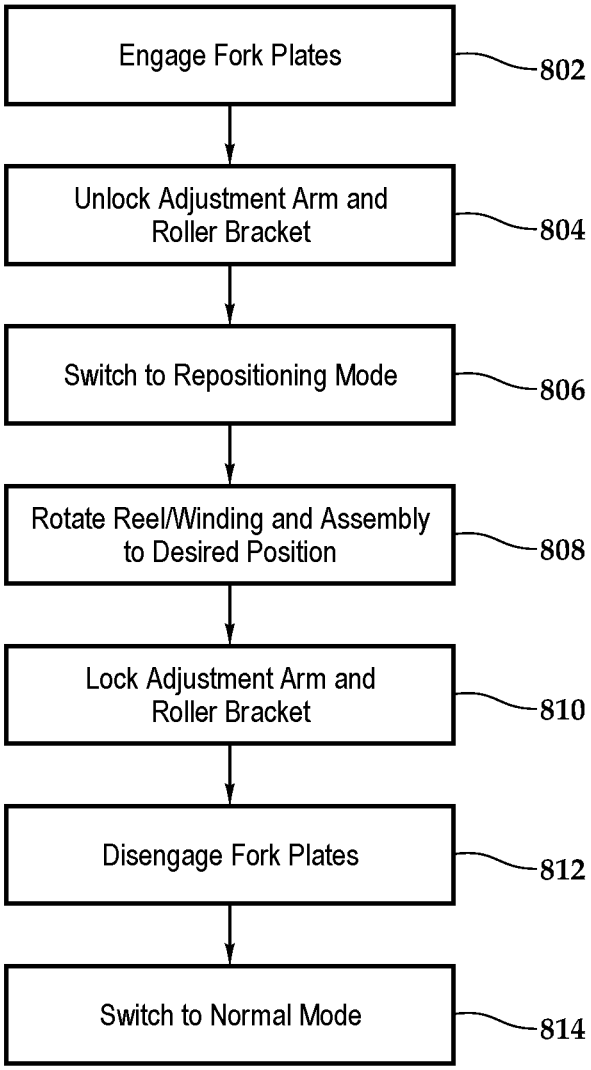
FIG. 8 shows flow chart for a level wind repositioning process for an exemplary reel assembly having a repositionable level wind.

3.0 Exemplary Drive Systems 200 and Exemplary Methods for Repositioning a Level-Wind A pneumatic schematic for controlling the reel pneumatic drive system 200 is shown in FIG. 7 and a flow chart for an exemplary process 800 for repositioning the winding assembly 25 is shown in FIG. 8. In addition, FIGS. 9*a-d* show various side views of portions of an exemplary reel with forks and repositionable level winds during various stages of a reposition process. In FIG. 9*a-d*, the guide rail 110*b* and adjustment arm 120 have been removed to better illustrate the interaction of the fork plate 140*b* and the level wind 25.

Figure 9A:
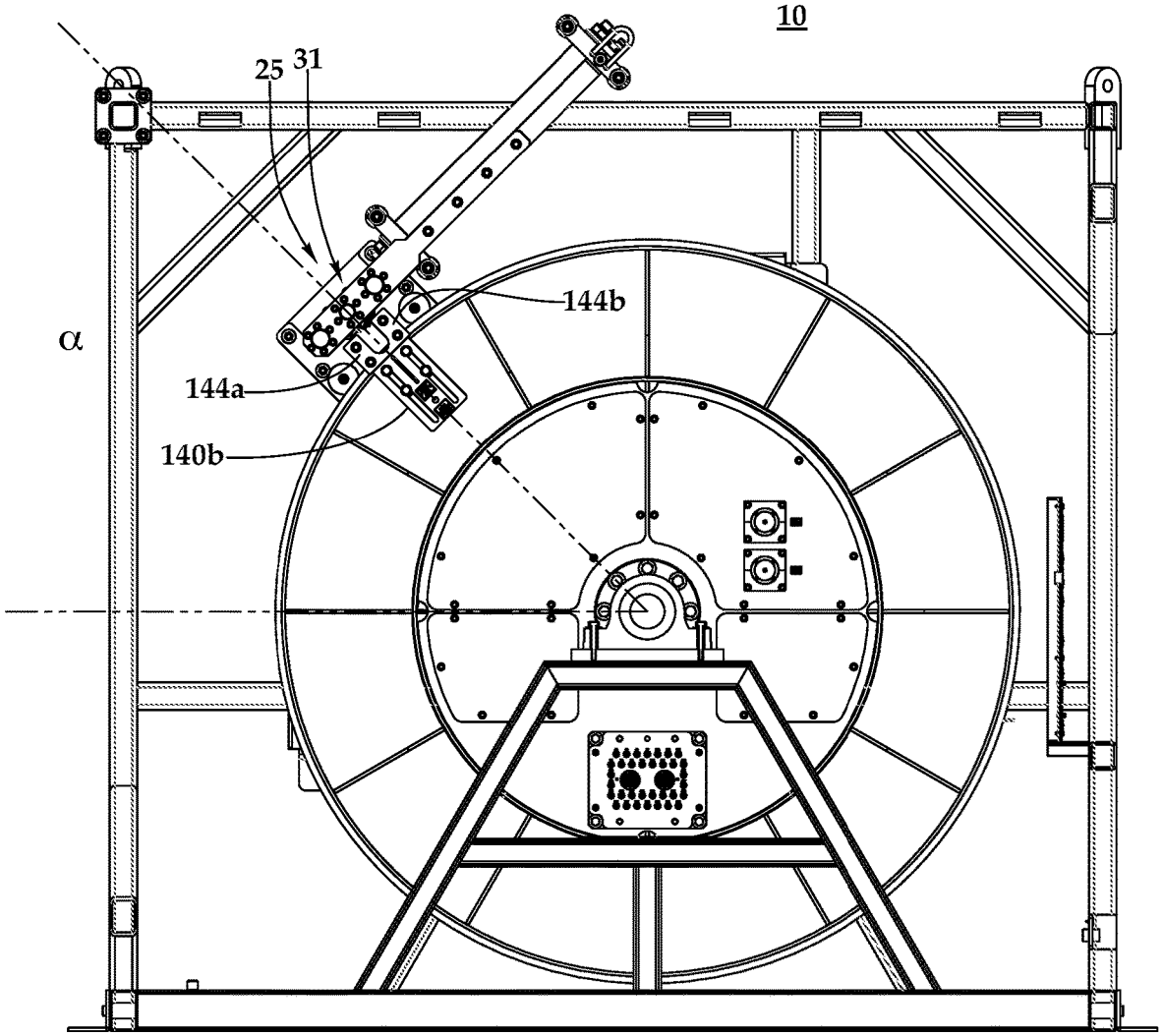
FIGS. 9*a-d* show various side views of portions of an exemplary reel with forks and repositionable level winds during various stages of a reposition process.
Figure 9B:
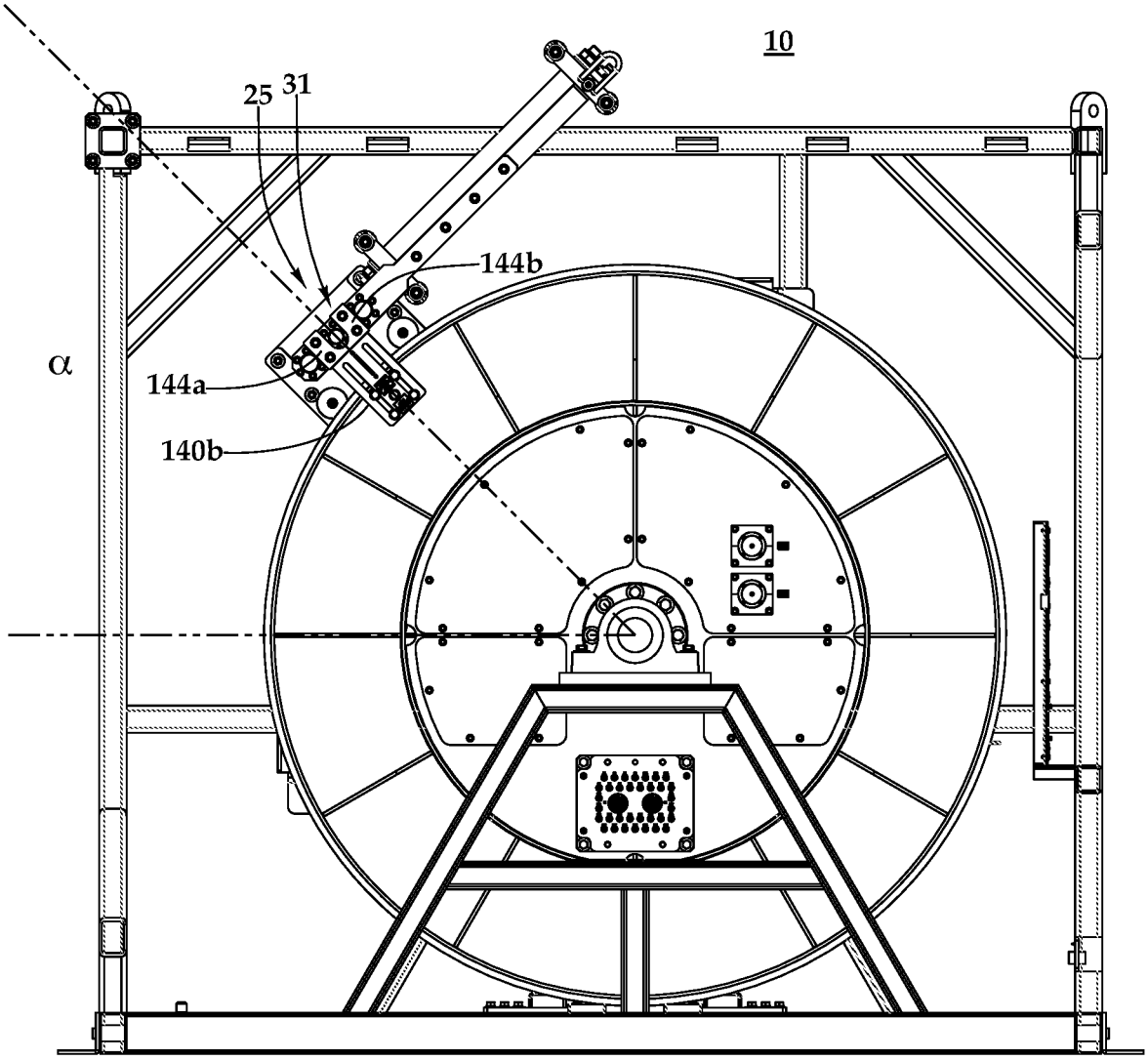

As shown in FIG. 9*a*, the level wind 25 may begin at a first position, which corresponds to a deployment position a of about 45° in the illustrated embodiment. To begin the repositioning process, an operator may (1) loosen the bolts securing the fork plates 140*a-b*, (2) manually move the fork plates 140*a-b* from a disengaged position (as shown in FIG. 9*a*) to an engaged position (as shown in FIG. 9*b*), and (3) tighten the bolts to lock the fork plates 140*a-b* them in the engaged positon at step 802. As noted about above, when in the engaged position, the tines 144*a-b* of the fork plates 140*a-b* may be positioned within the gaps 31 and 33 of (as shown in FIG. 6*b*).

Next, the operator may unbolt the adjustment arm 120 and roller bracket 130 at step 804. The operator then may depress the "level wind reposition" selector valve 210 at step 806 to switch from a normal operational mode to a repositioning operational mode. In the illustrated embodiment, selection of selector valve 210 may direct air to the manual, lever operated, reel directional control valve 216. Air also may be directed to the pilot actuated, spring offset, pilot valve 214. Air also may be directed to pressure regulator valve 238, shuttle valve 240, and through pilot valve 242, and to remote operated, pressure regulator valve 244. Pilot valve 242 may remain in the spring offset position, since pressure is not available to shift the pilot valve 242. Pressure regulator valve 238 may be set to a level that permits repositioning the level wind assembly (such as about 80 PSI, for example).

In other words, depression of the "level wind reposition" selector valve 210 may shift the valves to level wind reposition locations in which they limit the output of the system as compare to the normal operational output in order to provide precise control of the rotation of the drum 12. For example, air may be directed out of the speed regulation port #8 of valve 216 to pilot operated air regulator valve 236. Air regulator valve 236 is normally closed, and opens with the application of pressure. The more pressure applied, the more the valve opens and the faster the reel will rotate. For example, the pressure may range from about 10 PSI to about 80 PSI, preferably from about 20 PSI to about 50 PSI and even more preferably between about 25 PSI and about 35 PIS. In the illustrated embodiment, the pressure may be about 30 PSI. Normal reel rotation would be at a faster rotational speed, typically about 5-6 revolutions per minute, whereas rotation during the repositioning mode preferably would be between about 0.05 revolutions per minute about 0.5 revolutions per minute, and even more preferably about 0.1 revolutions per minute.

Next, the operator may move the lever of the manual, lever operated, reel directional control valve 216 as desired at step 808. When the lever is moved to the reel out position, air may directed through shuttle valves items 218 and 220, pilot valve 214, pressure regulator valve 222, shuttle valve 224, quick exhaust valve 226, and to the spring applied, pneumatic released disc brake caliper 228. The more pressure applied to the caliper the less holding force the caliper will develop. Preferably, only enough pressure (such as about 40 PSI, for example) is developed to prevent the level wind assembly from falling, due to its weight. For example, the pressure may range from about 10 PSI to about 80 PSI, preferably from about 25 PSI to about 55 PSI and even more preferably between about 35 PSI and about 45 PIS. In the illustrated embodiment, the pressure may be about 40 PSI. Preferably, the level wind is repositioned in the reel out direction.

When rotating in the reel in direction, the disc brake may be fully released, and rotational speed controlled as described above. When the lever is moved to the "reel in" position, air is directed through shuttle valves 218, 224 and 246, quick exhaust valve 226, and to the spring applied, pneumatic released disc brake caliper 228. Since the weight of the carriage assembly may not be an issue in the reel in direction, the brake may be fully released.

Figure 9C:
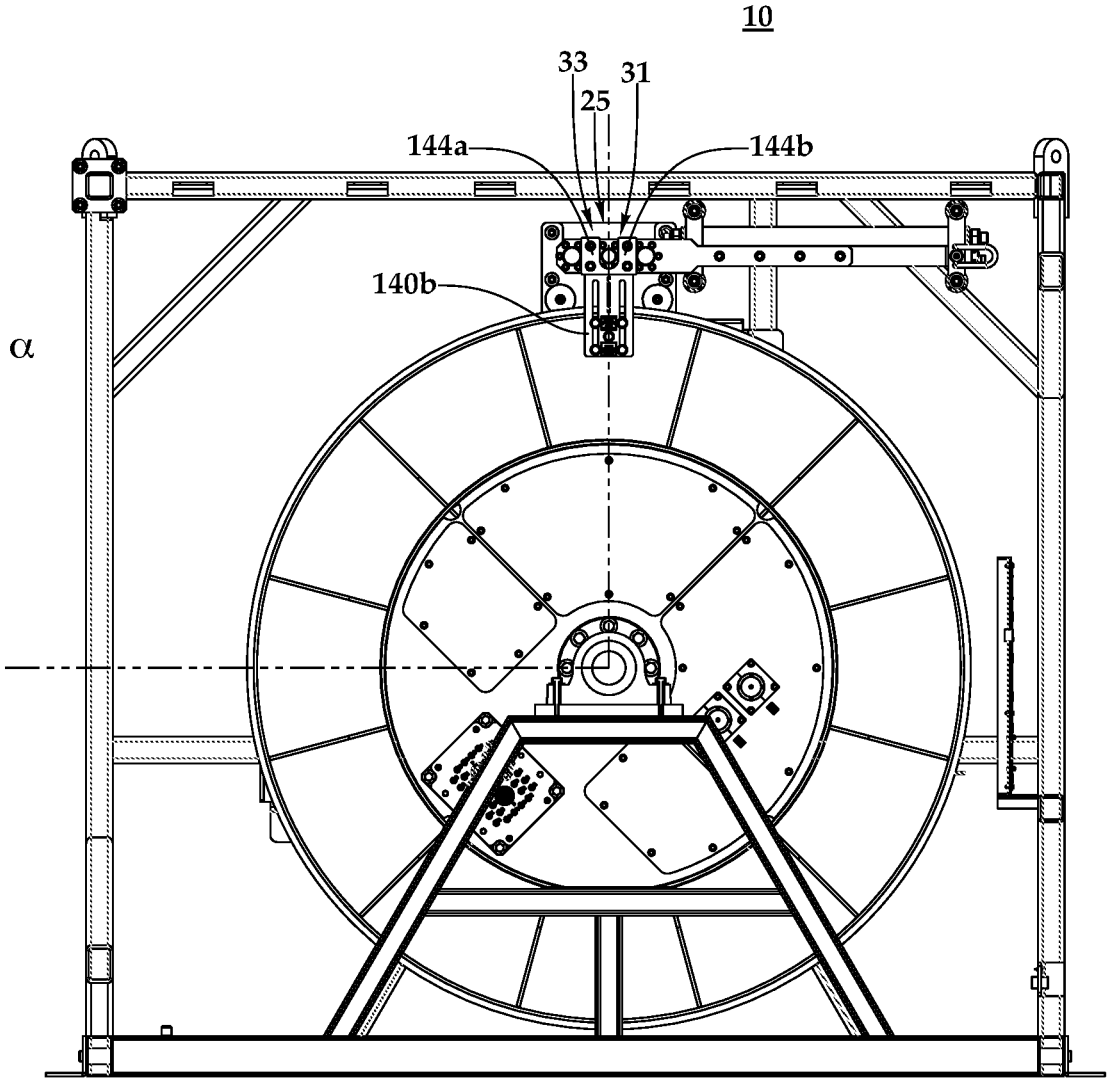
Figure 9D:
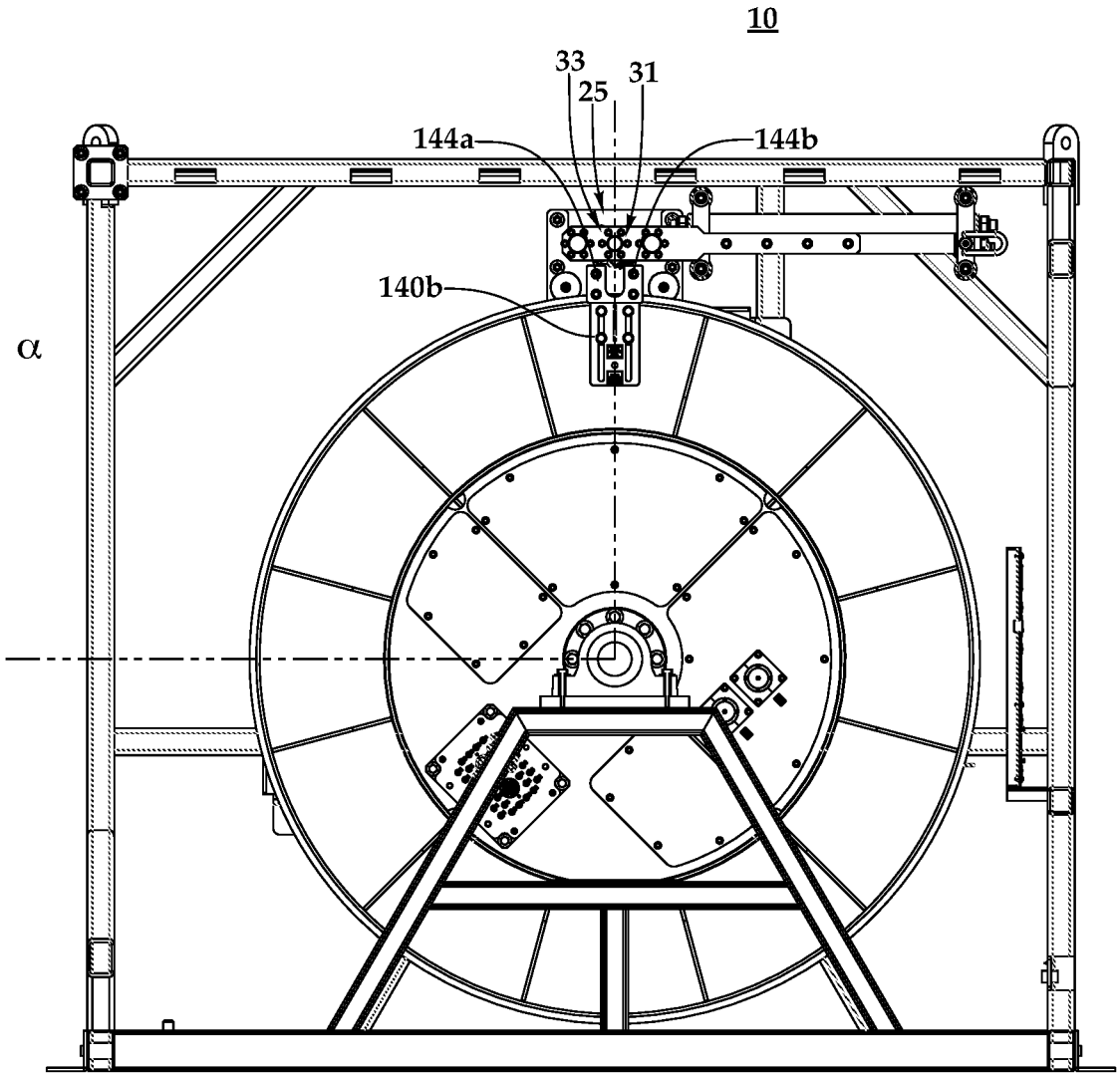

Once the level wind assembly 25 is repositioned to the desired deployment angle $\alpha$ (as shown in FIG. 9*c*), the adjustment arm 120 and roller bracket 130 may be bolted to the guide rails 110*a-b* to lock the level wind 25 into place at step 810. In the illustrated embodiment, the second position corresponds to a deployment angle α of about 90°. Next, the two forks 140*a-b* may be manually repositioned to disengage from the two carriage guide rods 34 and 36, and locked in the disengaged position at step 812 (as shown in FIG. 9*d*). Finally, the "level wind reposition" selector valve 210, may be pulled, directing air to the system for normal reel operation at step 814.

Although schematic 200 shows a manually controlled pneumatic drive system, other types of drive systems, such as electro-pneumatic drive systems or an electric drive (e.g. electric motor) also may be used. For example, in some embodiments, the reel repositioning components outlined here may be added to the modifications may be made to the electro-pneumatic control systems described in U.S. patent application Ser. No. 16/285,939 filed Feb. 26, 2019, which is a continuation of U.S. patent application Ser. No. 15/723,638 filed Oct. 3, 2017 (now U.S. Pat. No. 10,233,705), which is a continuation-in-part of U.S. patent application Ser. No. 14/945,195 filed Nov. 18, 2015 (now U.S. Pat. No. 9,810,032), which is a continuation of U.S. patent application Ser. No. 14/802,814 filed Jul. 17, 2015 (now U.S. Pat. No. 9,206,658), all of which are incorporated by reference in their entirety.

As another example, some embodiments may use an electric drive system to rotated the drum 12 and/or level wind 25. For example, an electric servomotor may be used. In such embodiments, the operator may be able to select a desired angle of deployment for the level wind 25, in response, the servomotor may rotate the drum to the desired angle. For example, the operator may select a reposition mode similar to that described above and may then set a specific angle, such as 45° or 90°, and the level wind may be moved to a corresponding position. The other aspects of the reposition process describe above, such as the bolting and unbolting of the adjustment arm 120 and roller bracket 130 to the guide rails 110*a-b* and the moving of the fork plates 140*a-b* from the disengaged position to the engaged position and back again, may be substantially similar. Other electric drive systems and/or motors also may be used.

4.0 Other Exemplary Configurations

As described above, the repositionable level wind assembly 100 may be selectively coupled (or selectively couplable) to the drum 12 (at the flange 16 via the fork plates 140*a-b*) for powered movement from a first position to a second position. Other configurations also may be used to achieve similar functionality. For example, in some embodiments, the adjustment arm 120 may be selectively couplable to the drum 12 via a clutch between the arm 120 and the center drum 12 (or other part of the drum 12). As another example, one or more separate power sources may be attached to the winding assembly 25, such as attached to one or more roller brackets 130 that cause the carriage to move appropriately to wind the cable as well as to cause the one or more roller brackets 130 to move between positions on the guide rails 110*a-b*, for example, by powering rotation of one or more of the rollers 122*a-c*.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A reel assembly for accepting, holding, and deploying cable, hose, or umbilical connection, comprising:

a spool assembly including a frame and a drum mounted in said frame, the drum including a core and end flanges for storing said cable, hose or umbilical connection;

a motor;

a drive unit, the motor coupled to the drum via the drive unit;

a guide rail having a plurality of positions; and a level wind assembly selectively couplable to the drum for powered movement from a first position along the guide rail to a second position along the guide rail.

2. The reel assembly of claim 1, where the positions of the guide rail are defined by sets of apertures.

3. The reel assembly of claim 1, where the drive unit further comprises a selector valve for switching between a normal mode and a repositioning mode.

4. The reel assembly of claim 3, where an overall output of the drive unit is limited in the repositioning mode.

5. A reel assembly for accepting, holding, and deploying cable, hose, or umbilical connection, comprising:

a spool assembly including a frame and a drum mounted in said frame, the drum including a core and end flanges for storing said cable, hose or umbilical connection;

a motor;

a drive unit, the motor coupled to the drum via the drive unit;

a guide rail having a plurality of positions; and a level wind assembly selectively couplable to the drum for powered movement of the level wind assembly from a first position along the guide rail to a second position along the guide rail, wherein a fork plate is attached to the drum for selectively coupling the level wind assembly to the reel.

6. The reel assembly of claim 5, where the fork plate is moveable from a disengaged position in which the level wind is not coupled to drum and an engaged position in which the level wind is coupled to the drum.

7. The reel assembly of claim 6, where the level wind further includes a diamond screw shaft disposed between two guide rods, and where the fork plate further includes two tines, each tine adapted to fit between the diamond screw shaft and a corresponding one of the guide rods when the fork plate is in the engaged position.

8. A reel assembly for accepting, holding, and deploying cable, hose, or umbilical connection, comprising:

a spool assembly including a frame and a drum mounted in said frame, the drum including a core and end flanges for storing said cable, hose or umbilical connection;

a motor;

a drive unit, the motor coupled to the drum via the drive unit;

a guide rail having a plurality of positions;

a level wind assembly selectively couplable to the drum for powered movement from a first position along the guide rail to a second position along the guide rail; and an adjustment arm fixedly coupled to the level wind and rotatably coupled to the drum.

9. The reel assembly of claim 8, where the flanges of the drum each include an upper track and a lower track, and where the adjustment arm includes a plurality of rollers for engaging the upper track and the lower track of a corresponding one of the flanges.

10. The reel assembly of claim 9, further comprising a roller bracket coupled to the level wind as an end distal the adjustment arm, the roller bracket including a plurality of rollers for engaging the upper track and the lower track of the other one of the flanges.

11. A reel assembly for accepting, holding, and deploying cable, hose, or umbilical connection, comprising:

a spool assembly including a frame and a drum mounted in said frame, the drum including a core and end flanges for storing said cable, hose or umbilical connection;

two fork plates, each fork plate adjustably coupled to one of the end flanges of the spool assembly;

a motor;

a drive unit, the motor coupled to the drum via the drive unit; and a repositionable level wind assembly comprising:

two arc-shaped guide rails, an adjustment arm rotatably coupled to the spool assembly, the adjustment arm coupled to one of the arc-shaped guide rails, a roller bracket coupled to the other of the arc-shaped guide rails, and a winding assembly having two guide rods and a rotatable diamond screw shaft, where the fork plates may be moved to engaged positions that couple the adjustment arm and the roller bracket to the flanges so that rotation of the drum causes the winding assembly to be rotated along the guide rails.

12. The reel assembly of claim 11, where each fork plate further includes two tines, each tine adapted to fit between the diamond screw shaft and a corresponding one of the guide rods when the fork plate is in the engaged position.

13. The reel assembly of claim 11, where the arc-shaped guide rails include a plurality of defined positions, each position defined by a set of apertures.

14. The reel assembly of claim 13, where the plurality of defined positions are offset by about fifteen degrees.

15. The reel assembly of claim 11, further comprising an air motor coupled to the drum via the drive unit, where the drive unit further comprises a selector valve for switching between a normal operational mode and a repositioning operational mode.

16. The reel assembly of claim 11, further comprising an air motor coupled to the drum via the drive unit, where the drive unit further comprises a selector valve for switching between a normal operational mode and a repositioning operational mode.

17. The reel assembly of claim 11, where the roller bracket includes two sides and a bumper disposed in each side, and where adjustment arm includes two sides and a bumper disposed in each side.

18. The reel assembly of claim 11, where the flanges of the drum each include an upper track and a lower track, and where the adjustment arm includes a plurality of rollers for engaging the upper track and the lower track of a corresponding one of the flanges.

19. The reel assembly of claim 18, where the roller bracket includes a plurality of rollers for engaging the upper track and the lower track of the other one of the flanges.

20. A reel assembly for accepting, holding, and deploying cable, hose, or umbilical connection, comprising:

a spool assembly including a frame and a drum mounted in said frame, the drum including a core and end flanges for storing said cable, hose or umbilical connection;

two fork plates, each fork plate adjustably coupled to one of the end flanges of the spool assembly;

a motor;

a drive unit, the motor coupled to the drum via the drive unit; and a repositionable level wind assembly comprising:

two arc-shaped guide rails, each including a plurality of defined positions offset by about fifteen degrees, each position defined by a set of apertures, an adjustment arm rotatably coupled to the spool assembly, the adjustment arm coupled to one of the arc-shaped guide rails, a roller bracket coupled to the other of the arc-shaped guide rails, and a winding assembly having two guide rods and a rotatable diamond screw shaft, where the fork plates may be moved to engaged positions that couple the adjustment arm and the roller bracket to the flanges so that rotation of the drum causes the winding assembly to be rotated along the guide rails.

* * * * *